US008528996B2

(12) United States Patent
Chupp et al.

(10) Patent No.: US 8,528,996 B2
(45) Date of Patent: Sep. 10, 2013

(54) EXPANDABLE TABLE ARRANGEMENT AND THE LIKE, ESPECIALLY SUITED FOR USE IN RECREATIONAL VEHICLES

(75) Inventors: Carl Chupp, Elkhart County, IN (US); Robert Fisher, Elkhart City, IN (US); Steve Hulse, Elkhart County, IN (US); Doug Kemp, St Joseph, IN (US); Mike Walter, Koscicsko County, IN (US); Mahlon Miller, Mashall County, IN (US)

(73) Assignee: Newmar Corporation, Nappanee, IN (US)

( * ) Notice: Subject to any disclaimer, the term of this patent is extended or adjusted under 35 U.S.C. 154(b) by 139 days.

(21) Appl. No.: 12/927,891

(22) Filed: Nov. 29, 2010

(65) Prior Publication Data

US 2012/0133254 A1 May 31, 2012

(51) Int. Cl.
*A47B 1/00* (2006.01)

(52) U.S. Cl.
USPC ..... 312/297; 108/67

(58) Field of Classification Search
USPC ..... 108/67, 68, 137, 33, 40, 44; 312/297, 312/317.1, 317.3, 277, 241, 319.1, 203, 334.27, 312/334.29, 334.31–334.33; 296/24.44, 296/100.09, 100.12
See application file for complete search history.

(56) References Cited

U.S. PATENT DOCUMENTS 323,520 A * 8/1885 Neumer et al. ..... 108/68
508,938 A * 11/1893 Hamilton ..... 108/33
574,759 A * 1/1897 Pickett ..... 312/204
963,502 A * 7/1910 Bond ..... 108/68
1,566,200 A * 12/1925 Girad ..... 108/93
1,950,927 A * 3/1934 McMillan ..... 296/181.4
2,038,838 A * 4/1936 Greyson ..... 108/93
2,201,354 A * 5/1940 Steadman ..... 312/235.6
2,214,653 A * 9/1940 Barlough ..... 160/201
2,588,706 A * 3/1952 Davis ..... 108/45
2,677,571 A * 5/1954 Vaughn ..... 296/24.39
2,726,911 A * 12/1955 Mason ..... 108/93
2,778,698 A * 1/1957 Gaylord ..... 108/33
2,848,291 A * 8/1958 Edelson et al. ..... 108/93
2,869,956 A * 1/1959 Gaines ..... 312/297
2,964,372 A * 12/1960 Yoder ..... 312/317.3
3,072,453 A * 1/1963 Evans et al. ..... 312/317.3
3,129,752 A * 4/1964 Whiting ..... 160/201

(Continued)

*Primary Examiner* — Janet M Wilkens
(74) *Attorney, Agent, or Firm* — Ryan M. Fountain

(57) ABSTRACT

A table or similar structure is provided having an expandable surface area arrangement where the usable or working surface area is retractable into and out of a housing along a curvilinear path that includes both horizontal and vertical components and wherein weight compensating structure is provided to offset the impact of vertical movement of the surface area. The usable surface is formed from an array of adjacent panels connected by a backing web which allows them to lie flush together when the surface area is retracted for use and to separate as needed to follow the curvilinear path when retracted into the housing for storage. The extent of movement into and out of the housing is variable according to the amount of surface area required in a given instance. When implemented into a dining table, for example, vertical support legs for one end of the table can be attached to the end panel of the surface area which is first withdrawn from the housing. The panel are supported by telescopic guide rails which retract into and out of the housing coincident with the movement of the panels, but to which all of the panels are not fixed at all times. The housing can include an opening to allow debris to be removed from the panels even when retracted into the housing.

5 Claims, 2 Drawing Sheets

(56) References Cited

U.S. PATENT DOCUMENTS 4,263,854 A * 4/1981 Moore et al. ..... 108/37
2005/0189785 A1* 9/2005 Harder ..... 296/171
2006/0163911 A1* 7/2006 Bernstein et al. ..... 296/190.02
2010/0264793 A1* 10/2010 Gutnik ..... 312/319.1

* cited by examiner

EXPANDABLE TABLE ARRANGEMENT AND THE LIKE, ESPECIALLY SUITED FOR USE IN RECREATIONAL VEHICLES

BACKGROUND AND SUMMARY OF THE INVENTION

The present invention relates generally to furniture, cabinets, and tables with variable dimensions and, more particularly, to expandable surface areas for use in recreational vehicles.

A variety of tables, countertops, and work surfaces incorporated into furniture and cabinets are known. Many of these are expandable in dimension and/or orientation so as to increase the usable spaces or working areas. In some such items, dining room tables, for example, a "leaf" may be folded up or down on a hinge or added via one or more removable sections to accomplish this. However, folding leaves limit access to the area under the table, as for placement of legs and knees of those persons sitting about the table when the leaves are not in use. Removable sections typically require separate storage areas and are less readily implemented when expansion is needed due to their weight and size and the manipulation of the table to support them. Further, both of these methods of extension only permit the table to expand to pre-set dimensions, defined by the length of the leaf along the table length.

It is also known that the usable surface areas of table, cabinet, and furniture products can be made to vary in length according to need by sliding a surface area into and out of a housing. Such arrangements permit extension by variable lengths according to how far the sliding surface is pulled out. A simple example of this is a drawer which slides into and out of a cabinet and has a removable top surface or tray. Alternatively, cabinets have been formed with slide-out counter top extensions, as for example, in kitchen cabinets or desks. However, in general such extensions achieve that result by generally horizontal or merely planar motion of the relatively slidable components. Thus, the housing of the table or cabinet must have enough depth or width to contain within it the portion of the surface area that is to be retracted. At best then, such housings can be no smaller in depth than the retracted length of the surface area.

Unfortunately, this dimensional limitation can prevent those housings from being readily fit into certain confined areas. For example, if it is desired to have a table with a surface area that can be altered from 20 inches long to 50 inches long, then the housing can be no smaller than 30 inches wide (or deep, depending upon the orientation of the expandable surface being measured) in order to fully accommodate the 30 inches that is being slid into and out of it. If having a 30 inch wide housing is not convenient or permissible for a given facility at all times, then the expandable table cannot be used there.

Recreational vehicles (RVs), such as motor homes, typically have furniture within them, including tables and counters with work surfaces on them. Spacial availability within an RV, particularly floor space, can be limited compared to many homes or buildings. RV floor space dimensions are typically constrained to follow certain vehicular limitations in terms of drivability and road space, particularly road width. Also, RV dimensions and overall weight can be limited industry standards and/or by operator licensing and taxing requirements of state and local governments. Thus, furniture and cabinet fixtures within an RV are subject to spacial confinements.

RVs can be made to include significant amounts of storage space, but not necessary adjacent or readily accessible to the floor space where furniture is being used. Storage areas are typically created within the RV interior, but more commonly, large storage areas are built in under or above the floor space or with primary access on the vehicle exterior.

Further, RVs typically have floor space enhancement devices, called "slide-outs," installed at one or more locations within the vehicle on both motorized and towable products. Slide-outs are, in effect, typically open sided boxes which are movable between positions into and out of the RV body at the outer walls while maintaining a connection to the RV such that the interior floor space remains enclosed from the exterior weather. Slide-outs are, for example, supported by guide rails and moved by rack and pinion or chain drive motors (electric or hydraulic in nature) mounted on the underside or top of the movable box. Slide-outs can expand the effective floor space of the RV when they are moved outwardly of the RV body.

However, slide-outs are typically only usable when the RV is stopped, since driving along a road with the slide-out in an extended position would typically cause the RV to exceed the permitted vehicular width. Thus, slide-outs can be used to facilitate expandable furniture to a degree, since they can accommodate the larger spacial requirements of such products, but typically only when the vehicle is stopped so that the slide-out can be extended for use. Slide-outs can be, however, a relatively expensive addition to an RV and can add significantly to the overall RV weight, depending upon the construction of the slide-out and the drive mechanisms used. Extra weight can detrimentally affect the fuel economy of using an RV. Further, slide-outs typically need to be constructed with significant weather proofing arrangements to prevent, for example, rain leakage at the junctions of the slide-out walls and the RV walls. There is, with some slide-out constructions, a risk that these arrangements will fail, allowing weather damage to the interior of the RV and its contents. Accordingly, some RVs do not include slide-outs or limit the number of slide-outs placed within the vehicle.

Accordingly, it is a object of the present invention to provide improvements in expandable furniture, tables, cabinets, and the like which provide variations in usable surface area according to the users' need in a given instance. Other objects include the provision of expandable surface area arrangements which:

a. are inexpensive to manufacture and install,
b. can be accommodated into a variety of furniture and/or cabinet products,
c. are sufficiently sturdy and reliable for use in transportation systems, such as RVs, where there can be significant vibrational forces applied to such products over time,
d. are relatively light weight in construction, and
e. are convenient to implement and use for a variety of users.

These and other objects of the present invention are achieved by an expandable surface area arrangement where the usable or working surface area is retractable into and out of a housing along a curvilinear path that includes both horizontal and vertical components and wherein weight compensating structure is provided to offset the impact of vertical movement of the surface area. The usable surface is formed from an array of adjacent panels connected by a backing web which allows them to lie flush together when the surface area is retracted for use and to separate as needed to follow the curvilinear path when retracted into the housing for storage. The extent of movement into and out of the housing is variable according to the amount of surface area required in a given instance. When implemented into a dining table, for example, vertical support legs for one end of the table can be attached to the end panel of the surface area which is first withdrawn from the housing. The panel are supported by telescopic guide rails which retract into and out of the housing coincident with the movement of the panels, but to which all of the panels are not fixed at all times. The housing can include an opening to allow debris to be removed from the panels even when retracted into the housing. Other objects, advantages and novel features of the present invention will become readily apparent to those skilled in the art from the following detailed drawings and description of preferred embodiments.

DETAILED DESCRIPTION OF PREFERRED EMBODIMENTS

Figure 6:
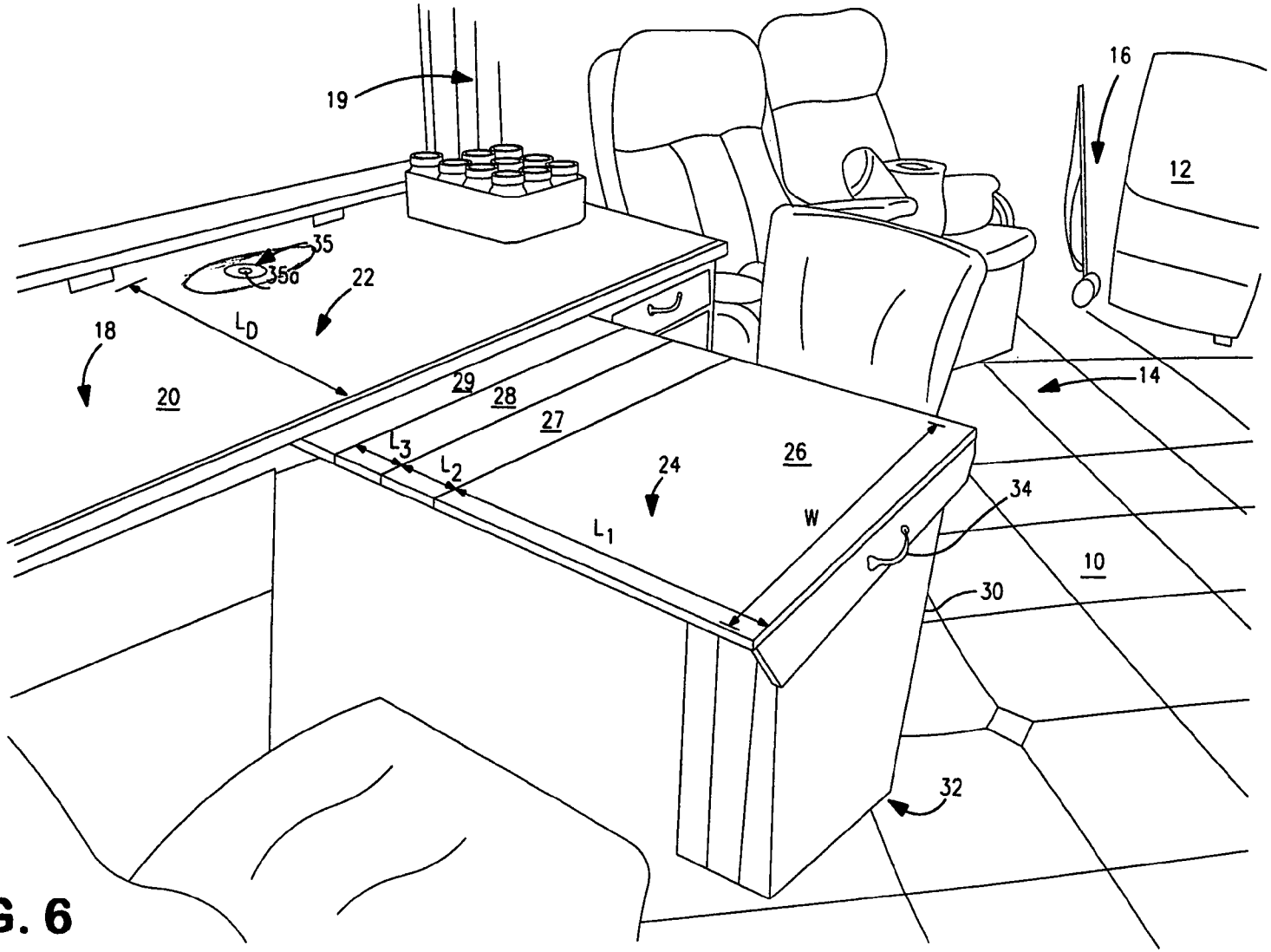
FIG. 6 shows a front, left perspective photographic view of a preferred embodiment of the present invention as mounted in interior of a motorized RV, with the direction of view toward the front of the RV and shown with the working surface area partially extended from the housing of a built-in desk.

Preferred embodiments of the present invention include, but are not limited to, built-in furniture or cabinet structures for recreational vehicles, such as a wall mounted desk or cabinet having a top surface area, such as is shown in FIG. 6. For purposes of illustration and orientation, FIG. 6 shows an RV interior with a floor 10, driver's seat 12, slide-out area 14 (in an extended position outwardly from the RV body wall or driver's door 16), a built-in desk 18 having a top surface 20. This desk is, for example, attached to the outer wall section 19 of the slide-out and serves as a housing for the present invention beneath area 22. The present invention includes a working surface area 24 comprising a plurality of panel elements. As shown in FIG. 6, the working surface area is partially extended from desk 18 and several (but not all) of the panel elements, 26, 27, 28, and 29 are shown.

Panel element 26 is, for example, the same width W as panel elements 27-29, but is longer in length L1 than either panel element 27 (with length L2) or panel element 28 (with length L3). The length of panel element 26 is preferably less than or equal to the length LD of desk 20 where the present invention is desired to retract completely into housing 22 and present a "flush" front appearance with desk 20 when the present invention is "closed." For purposes of orientation in the figures and this description, the "length" of the working surface area or panel elements of the present invention refers to the measurement of the amount of that feature which can be extended out from the desk or housing to provide a usable space in the lateral dimension with respect to the RV.

As shown, panel element 26 extends generally horizontally and parallel to floor 10. Panel element 26 is connected, for example, to a pair of vertical support legs 30. To facilitate movement along floor 19, each leg 30 includes, for example, a conventional roller structure 32 attached to the lower portion of the leg. Panel element 26 can be manipulated by users for sliding movement into and out of housing 22 by a variety of conventional means to grip or engage the present invention, including, for example, handle 34. Panel elements of the present invention can be formed from any number of desired materials, including polished wood, natural or artificial stone, or various synthetics or plastics. Preferably, the panel elements are disposed to fit together snugly and without significant gaps therebetween when working surface area 24 is extended from housing 22, as is shown by FIG. 6.

Also, it has been found to be advantageous in particular embodiments to include a removable panel 35 in top surface 20 adjacent the back of housing 22 to facilitate maintenance, cleaning of, or removal of debris from the portions of the present invention which are hidden from view during different modes of use. Various conventional means of opening panel 35 are envisioned, including finger hole 35*a*, as shown in FIG. 6.

FIGS. 1-5 illustrate the construction of preferred embodiments of the present invention within housing 22. In general, working surface area 24 includes a plurality of panel elements 26-29 described above and 36, 38, and 40, which were hidden from view in FIG. 6 since in that view the working surface area was only partially extended from housing 22. These panel elements are connected by a web 42 of flexible material, such as, for example, a length of canvas sheet. The panel elements can be connected to web 42 by any number of conventional means, such as, for example, various glue or chemical adhesives, according to the bonding nature of the materials selected for the panel elements and the web. This web 42 serves to closely connect the panel elements as if by a hinge assembly.

Figures 1, 2, 3, 4, 5:
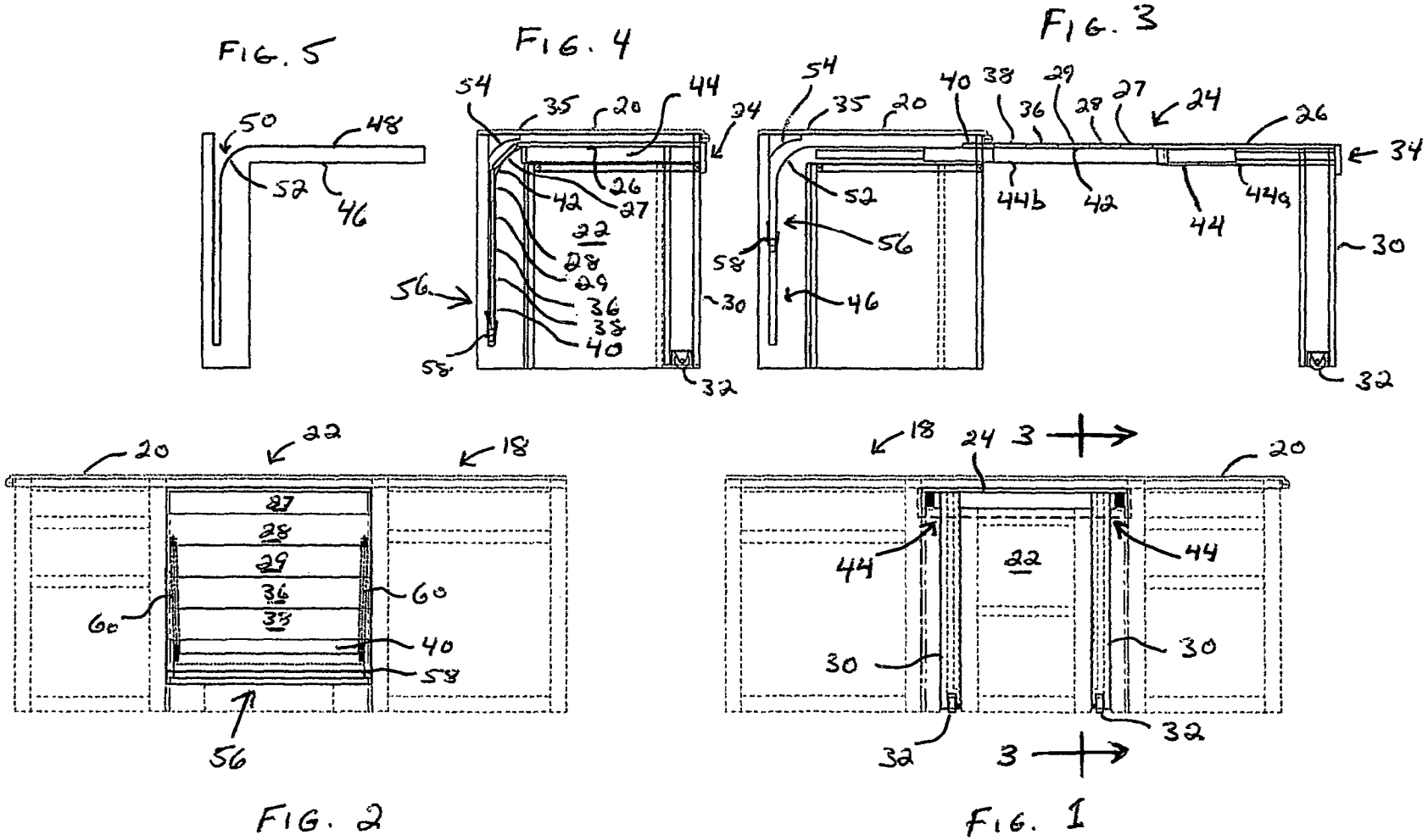
FIG. 1 shows a front view of a cabinet or desk structure incorporating a preferred embodiment of the present invention with the working surface area in either an extended or retracted position.
FIG. 2 shows a back view of the embodiment of FIG. 1 with the working surface area fully retracted into the housing of the desk or cabinet structure.
FIG. 3 shows a side view of the embodiment of FIG. 1 along line 3-3 with the working surface area fully extended out of the housing of the desk or cabinet structure.
FIG. 4 shows a side view of the embodiment of FIG. 1 along line 3-3 with the working surface area fully retracted into the housing of the desk or cabinet structure.
FIG. 5 shows a side view of the guide rail structure for the panel segments in a preferred embodiment of the present invention.

When extended from housing 22, the panel elements are preferably supported on at least a pair of telescopically sliding rails 44, such as telescopically slideable roller bearing rails. These rails are, for example, disposed beneath the panel elements toward each side of the panel elements along width W. The length of the telescopic extension of rails 44 will help define the limit of extension of the panel elements from housing 22. Where longer extension is desired without incurring the expense of specially made telescopic rails, conventional telescopic rails can be joined end-to-end to provide that longer extension. That form of structure is illustrated in FIG. 3 where each rail 44 on each side of the panel elements is formed from two rail elements 44*a* and 44*b*, joined back to back by welding. Rails 44 are mounted to housing 22 such that when the panel elements are retracted into housing 22 the rail elements are also retracted into that housing.

As the panel elements move within housing 22, they are supported by guide rail structure 46, preferably on each side of housing 22. In the embodiment shown in the figures, the underside of the panel elements rests, at each end along width W, upon the top surface 48 of structure 46 when the panels are within housing 22. Further, as the panel elements are retracted into housing 22 (such as when the user pushes on handle 34), structure 46 directs the panel elements into a vertically extending slot 50 over a bend 52 and bounded by an opposing guide element 54 mounted in a rearward portion of housing 22. In the embodiment shown, this vertical slot is downward along the curvilinear path imposed by guide rail structure 46 and guide element 54. However, in other applications of the present invention the vertical slot could be upwardly extending or include multiple bends of vertical and horizontal travel for the panel elements, according to the dimensions and orientation of the housing into which the present invention is incorporated.

When the panel elements are retracted into housing 22 and extend downwardly into slot 50, in especially preferred embodiments of the present invention, the last or inward most panel element 40 engages a weight compensating structure 56. This structure includes, for example, a tray 58 which is formed to receive the back edge, for example, of panel element 40 therein. A pair of resilient biasing devices, such as springs 60, are preferably attached to each side of tray 58 and connected to an upper portion of housing 22 such that, as the panel elements move downwardly in slot 50, after panel element 40 engages tray 58 and continues downward the springs are then expanded and thereby exert an upwardly biasing force on the panel elements. Other biasing components of a conventional nature can be used as a substitute for the springs in given applications of the present invention, such as hydraulic or pneumatic pistons or resilient rubber straps.

The effect of structure 56 is to serve as an upward thrust member to ease the force necessary for the user to extend or withdraw the panel elements from the housing when working surface area is desired for use. Structure 56 accomplishes this by, for example, counterbalancing the weight of the panel elements. It is not necessary for tray 58 to remain in engagement with panel element 40 in every application of the present invention or even to remain in engagement during the entire time panel element 40 is within slot 50. As shown in FIG. 3, in certain applications of the present invention it is sufficient to provide upward biasing force when only some of the panel elements are within slot 50, depending upon the weight of the panel elements used and the draw force expected of the user when withdrawing working surface area 24 from housing 22.

The present invention is illustrated in the figures as incorporated into a desk. However, this invention is readily adapted from use in a wall mounted cabinet. In that case, the panel elements can be directed into a curvilinear path for retraction into the cabinet or even in whole or part into the wall structure behind the cabinet. That wall structure can, for example, be an exterior wall of the RV itself.

Although the present invention has been described in detail with respect to certain embodiments, that is by way of illustration and example only. Various alternative arrangements will be readily understood by those of skill in the art as a result of the present disclosure. Accordingly, the spirit and scope of the present invention are limited only by the terms of the claims below.

What is claimed is:

1. An expandable surface apparatus for use in a confined area, comprising:

a movable portion, a housing with an opening for receiving at least part of the movable portion as the movable portion is retracted into or withdrawn out of the housing, a surface area on the movable portion formed from a plurality of panels movably connected to each other, a guide within the housing for defining the movement of the panels within the housing, that guide causing the panels to change direction of motion as the panels are moved within at least a portion of the housing, and biasing means connected to the movable portion for urging the panels toward motion out of the housing, wherein the movable portion includes a substantially horizontal guide means underlaying the surface area and that guide means is retractable into the housing when the movable portion is moved into the housing at least in part, and wherein the guide means is a pair of telescopically slideable roller bearing rails underlaying the surface area adjacent the sides of the surface area.

2. An expandable surface apparatus for use in a confined area, comprising:

a movable portion, a housing with an opening for receiving at least part of the movable portion as the movable portion is retracted into or withdrawn out of the housing, a surface area on the movable portion formed from a plurality of panels movably connected to each other, a guide within the housing for defining the movement of the panels within the housing, that guide causing the panels to change direction of motion as the panels are moved within at least a portion of the housing, and biasing means connected to the movable portion for urging the panels toward motion out of the housing, wherein the biasing means includes a thrust member for engaging a panel of the surface area and at least one spring member connected to the thrust member and to the housing, wherein the opening is at the front of the housing and the guide defines the movement of at least one of the panels initially toward the back of the housing and then about a curve to be in a vertical orientation with respect to the housing as the surface area is retracted into the housing, and wherein the biasing means includes a tray member for receiving an edge of at least one of the panels, and includes at least one resilient element connected between the tray member and the housing for biasing the tray member vertically along the guide toward the opening.

3. The apparatus according to claim 2 wherein the guide defines movement of at least one of the panels downward within the housing and the resilient member exerts a force to counterbalance at least in part the weight of at least one panel so as to ease the withdrawal of the movable member from the housing.

4. The apparatus according to claim 3 wherein the panels are movably connected via a web material which serves to hinge the panels into close connection with each other when the surface area is withdrawn from the housing and permits the panels to separate sufficiently from each other to move along the guide when the panels are within the housing.

5. The apparatus according to claim 4 wherein the housing includes a closable opening therein which permits access to portions of the panels and guide for facilitating cleaning thereof and removal of debris.

* * * * *